United States Patent [19]

Aust et al.

[11] 3,991,395

[45] Nov. 9, 1976

[54] THERMAL CIRCUIT BREAKERS

[75] Inventors: Ronald Aust; Gerald Claude Littlehales, both of Coventry; Michael Arthur Bocock, Hinckley; Albert Edward Mumford, Coventry, all of England

[73] Assignee: Lucas Industries Limited, Birmingham, England

[22] Filed: May 27, 1975

[21] Appl. No.: 580,723

[30] Foreign Application Priority Data

June 1, 1974 United Kingdom ..... 24545/74

[52] U.S. Cl. ..... 337/66; 337/75

[51] Int. Cl.[2] ..... H01H 71/16

[58] Field of Search ..... 337/66, 70, 75, 356

[56] References Cited

UNITED STATES PATENTS 3,361,882 1/1968 Clarke ..... 337/66

3,451,016 6/1969 Ellenberger ..... 337/66

3,706,057 12/1972 Ellenberger ..... 337/66

*Primary Examiner*—Harold Broome

*Attorney, Agent, or Firm*—Holman & Stern

[57] ABSTRACT

A thermal circuit breaker includes a movable contact assembly which is held in an operative position against a fixed contact assembly by means of a catch movable by means of a temperature sensing device which is responsive to the current flowing between the contacts. When this current exceeds a predetermined value the catch is released and the contacts move to the open position. A manually operable control is provided to effect resetting of the circuit breaker and it is additionally operable to effect opening of the contacts when it is required to stop current flow through the circuit which is protected by the breaker.

20 Claims, 6 Drawing Figures

THERMAL CIRCUIT BREAKERS

This invention relates to thermal circuit breakers of the kind comprising a housing, a fixed contact set mounted within the housing, a movable contact set within the housing, said movable contact set when in an operative position co-operating with said fixed contact set to permit the flow of electric current between a pair of terminals carried by the housing, temperature sensitive means including an element which is heated by the flow of electric current between said terminals, and which when the magnitude of the current flow exceeds a predetermined value deflects to allow the movable contact set to be moved to an inoperative position, and manually operable means for causing movement of the movable contact set between the operative and inoperative positions.

The object of the invention is to provide such a circuit breaker in a simple and convenient form.

According to the invention a circuit breaker of the kind specified comprises a first lever pivotally mounted at one end in the housing, first resilient means for applying a force to said first lever intermediate the ends thereof, the force exerted on said lever being at least in part dependent upon the position of said manually operable means, second and third levers positioned in the housing, said third lever mounting said movable contact set and having one end shaped to engage and be retained by a retaining edge, the other end of said third lever being pivotally connected to one end of said second lever, the other end of said second lever being operatively connected to the other end of said first lever, second resilient means acting on said third lever, the position of said retaining edge being determined by said temperature sensitive means, the arrangement being such that when the force exerted by said first resilient means is above a predetermined value and the one end of said lever is retained by said edge, said movable contact set will be in the operative position, and when said edge is moved by the temperature sensitive means the third lever will under the action of said second resilient means, pivot relative to the second lever to move the movable contact set to an inoperative position.

According to a further feature of the invention, the pivot axis between the second and third levers is movable so that when the third lever is released by said edge, the first and second levers are moved by said first resilient means thereby causing a reduction in the force exerted by said first resilient means.

According to a further feature of the invention, the reduction in the force exerted by said first resilient means is utilized to effect the release of a catch mechanism associated with said manually operable means, said manually operable means returning to an inoperative position, when said catch mechanism is released.

According to a further feature of the invention said manually operable means comprises a member forming an abutment for said first resilient means, the member being movable towards said first lever to increase the force exerted by the first resilient means on the first lever, the member having a pin and slot connection with said first lever whereby when the member is moved away from said first lever, a point will be reached at which continued movement of the member in said direction will cause movement of the first lever in a direction to effect movement of said movable contact set to its inoperative position.

According to a further feature of the invention, means is provided to prevent movement of the second and third levers when it is desired to move the movable contact set to the operative position, until said first resilient means has been stressed a predetermined extent, whereby the movable contact set will move rapidly to the operative position.

Examples of thermal circuit breakers in accordance with the invention will now be described with reference to the accompanying drawings, in which.

Figure 1:
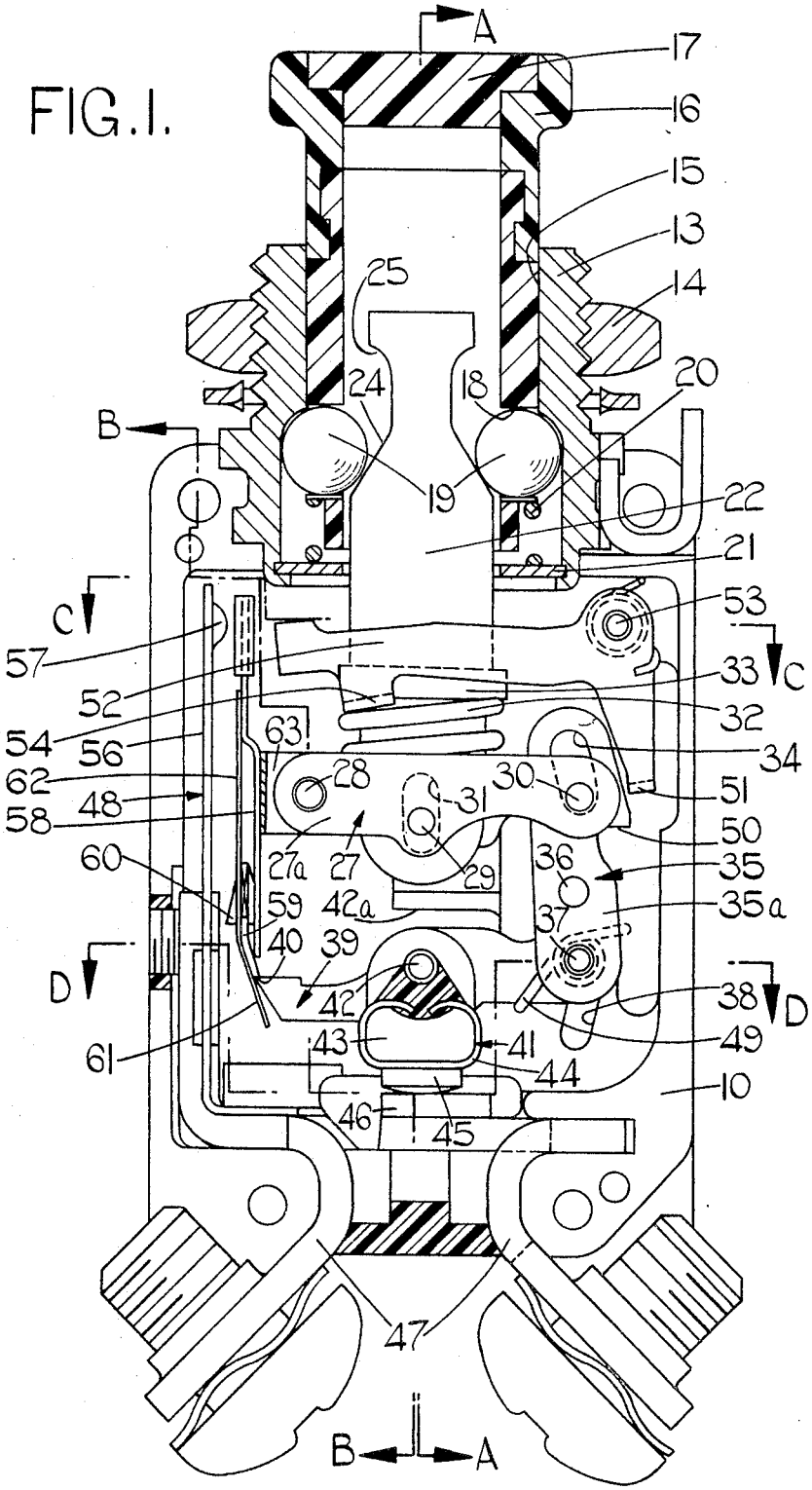
FIG. 1 is a sectional side elevation of one example of the breaker.
Figure 2:
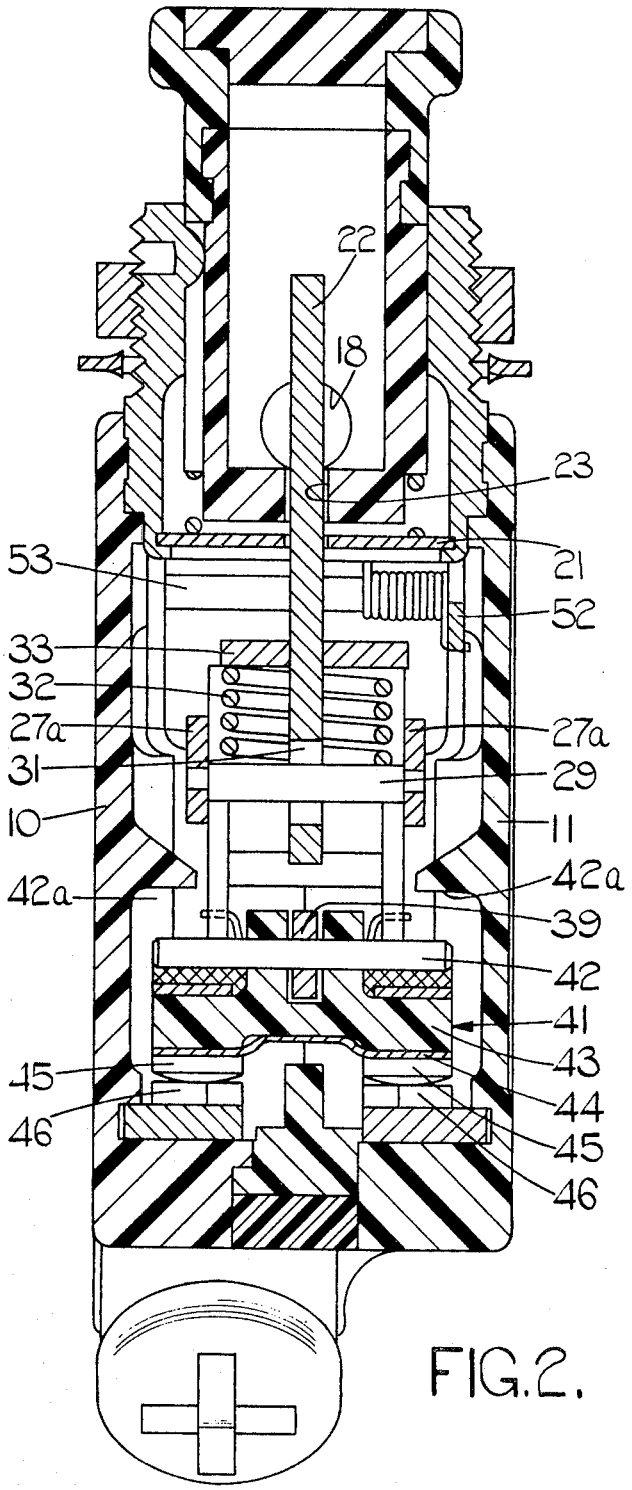
FIG. 2 is a sectional and elevation on the line AA of FIG. 1.
Figure 3:
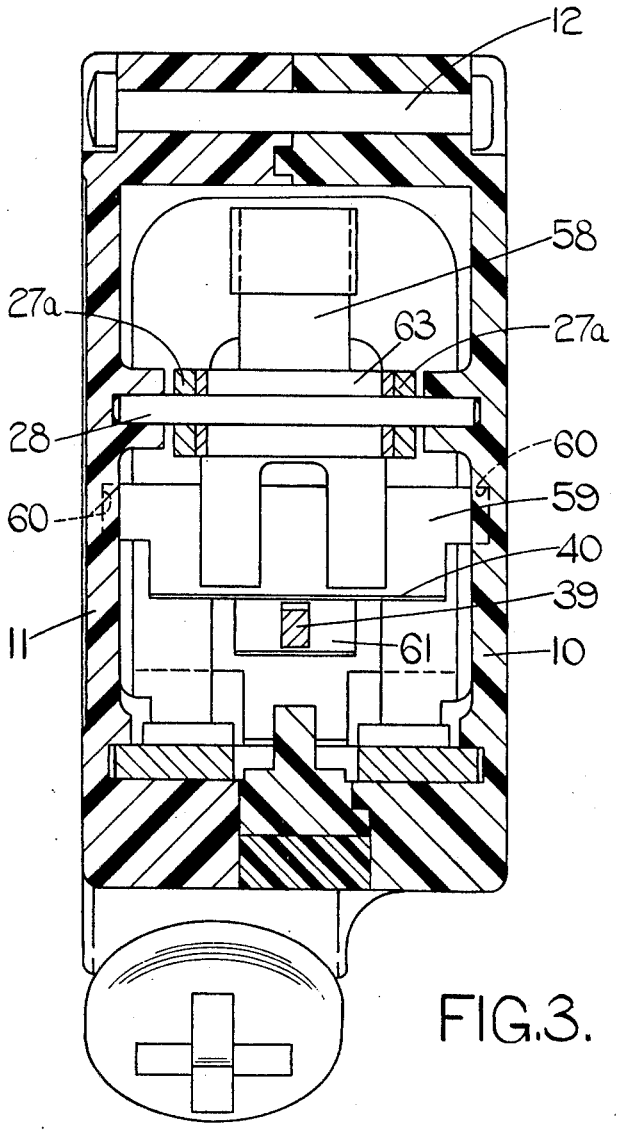
FIG. 3 is a view similar to FIG. 2 taken on the line BB of FIG. 1.
Figure 4:
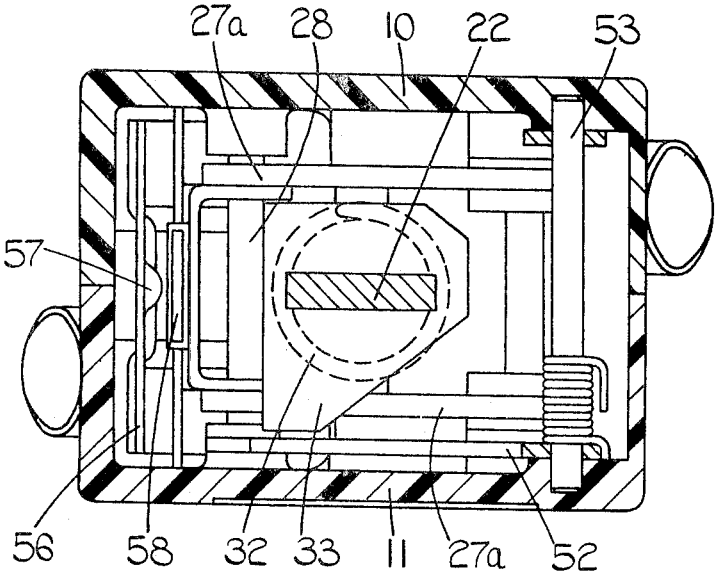
FIG. 4 is a sectional plan view taken on the line CC of FIG. 1.
Figure 5:
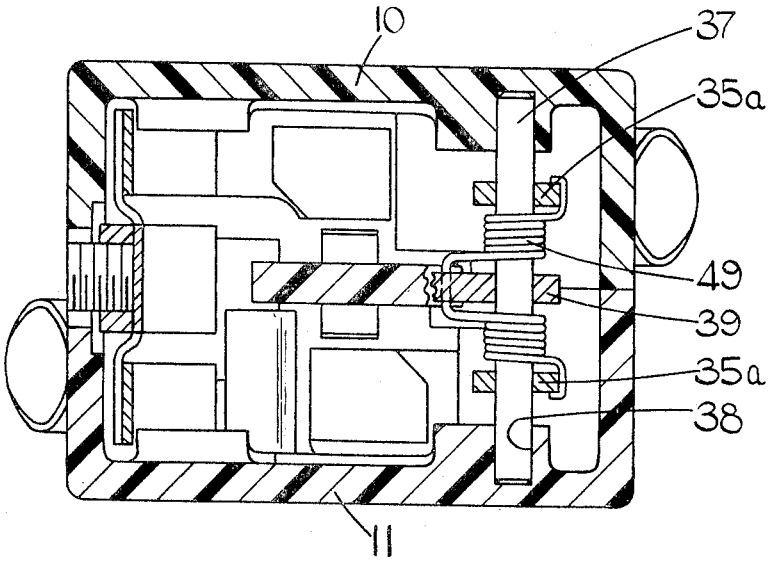
FIG. 5 is a sectional plan view taken on the line DD of FIG. 1.
Figure 6:
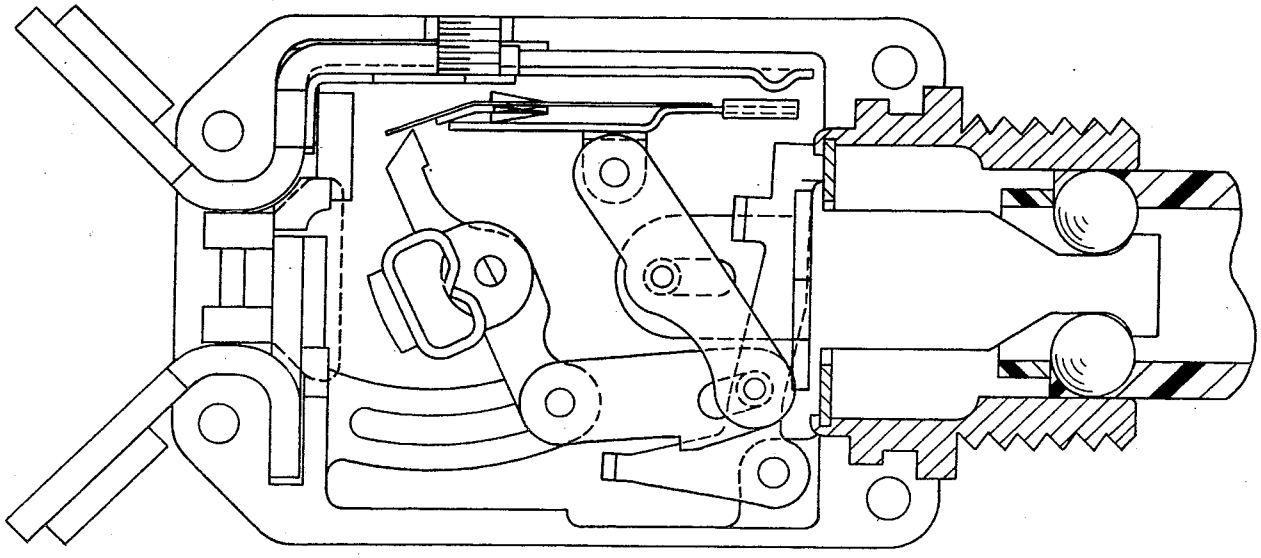

FIG. 6 is a view similar to FIG. 1 with the parts in an alternative position, With reference to FIGS. 1–6 of the drawings, the circuit breaker includes a housing which is formed in two parts 10,11 which are secured together by means of rivets 12 one of which is seen in FIG. 3. The two parts of the housing define a cavity one end of which is open and receives a hollow boss 13, the periphery of which is provided with a screw thread engageable by a nut 14 whereby the circuit breaker can be secured to a panel or the like.

The boss 13 defines a stepped cylindrical bore 15, the narrower end of which is disposed outermost from the cavity. The bore 15 mounts a manually operable member 16 which is of tubular construction and which has its outer end closed by a plug 17. Moreover, formed in the wall of the member 16 are a pair of apertures 18 in which are located balls 19 which form part of a catch mechanism. The balls 19 can co-operate with the step in the bore 15 to retain the manually operable member 16 in an operative position as shown in FIG. 1 of the drawings. Moreover, a coiled compression spring 20 is provided, and this surrounds a reduced portion of the member 16 and bears against the step defined between the reduced portion of the member 16 and the remaining portion thereof. The other end of the spring 20 bears against an abutment plate 21 which is secured within the wider end of the bore 15.

The manually operable member 16 accomodates a tongue member 22 which extends through a slot 23 formed in a base wall of the member 16. The tongue member 22 is provided with cam surfaces 24 which engage with the balls respectively to retain the balls against the step in the bore 15. For this purpose means to be described exerts a force on the tongue member 22 in a direction urging the tongue member out of the cavity. When this force is reduced, again as will be explained, the tongue partakes of inward movement, and the balls 19 can move inwardly thereby to release the member 16 which moves to its inoperative position under the action of the spring 20. When the member 16 is in the inoperative position, the balls 19 are sandwiched between the wall of the bore 15 and base portions of the cam surfaces 24. Furthermore, the balls engage with further cam surfaces 25 so that the tongue member 22 is moved outwardly by the action of the spring 20.

Mounted within the cavity is a first lever 27 which comprises a pair of spaced members 27*a* which are interconnected by three pins 28, 29 and 30. Pin 28, as seen in FIG. 3, extends into the two parts of the housing and defines a pivot axis for the one end of the first lever 27. Pins 29 and 30 serve to interconnect the members 27*a* and the pin 29 passes through an elongated slot 31 formed in the tongue member 22. Moreover, pin 29 serves as an abutment for one end of a coiled compression spring 32, the other end of which is engaged by manually operable means in the form of an abutment plate 33 mounted on the tongue member 22.

Pin 30 is accomodated within a slot 34 which is formed at one end of a second lever 35 which is made up by two members 35*a* which are held in spaced relationship and which are interconnected by pins 36 and 37. The ends of pin 37 extend into arcuate slots 38 formed in the two parts of the housing respectively. Also provided is a third lever 39, one end of which is pivotally connected to the lever 35 by means of the pin 37. The lever 39 at its end remote from the pin 37 is shaped for co-operation with a retaining edge 40, as will be described, and intermediate its ends, the lever 39 carries a movable contact set 41, the contact set 41 being secured to the lever by means of a pin 42 having outwardly extending ends which can co-operate with surfaces 42*a* defined on inwardly projecting portions of the two parts of the housing. The contact set 41 includes an electrically insulating body 43 which carries an electrically conductive strip 44 upon which are mounted a pair of contacts 45. The contacts 45 are engageable with a further pair of contacts 46 forming part of a fixed contact set mounted within the housing, and electrically connected to a pair of terminals 47 on the exterior of the housing. One of the terminals 47 is directly connected to one of the fixed contacts 46 whilst the other terminal is connected by way of a temperature sensitive means 48 which will be explained. Moreover, interposed between the levers 35 and 39 is a helically coiled spring 49 which biases the levers relative to each other.

The operation of the mechanism will now be described. In the position shown in the drawings, the circuit breaker is in the closed condition with the movable contact set in the operative position. In this condition, electric current can flow between the terminals 47. With the various parts of the circuit breaker in this condition, it is required that the movable contact set 41 should be movable to the inoperative position, either manually by an operator or in the event that excessive current flow occurs between the terminals 47. In the first instance, the operator can pull the operator control member 16 in an outward direction, and the effect of this is to supplement the force exerted by the spring 20. The effect is to move the balls 19 inwardly, this resulting initially in movement of the tongue member 22 inwardly into the cavity. With the balls released from the step defined between the narrower and wider portions of the bore 15, the member 16 can be moved outwardly, and such movement will be followed by corresponding movement of the tongue member 22. The tongue member 22 mounts the abutment for the spring 32 and the force exerted by this spring on the pin 29 will therefore gradually reduce. However, a point will be reached at which the pin 29 engages the end wall of the slot 31 and when this occurs, the lever 27 will be moved in an anti-clockwise direction as seen in FIG. 1. Movement of the lever 27 in the anti-clockwise direction will eventually lead to movement of the levers 35 and 39 as the pin 30 engages with the end wall of the slot 34. When this occurs, the spring 49 is stressed further and the lever 39 pivots about the edge 40 and in so doing the movable contact set is moved to an inoperative position so that the flow of electric current between the terminals 47 is prevented.

Considering now the second situation. When the magnitude of the current flowing between the terminals 47 increases to above a safe value, the temperature sensitive means 48 which includes bimetal elements as will be described, causes movement of the retaining edge 40 in a direction away from the contact set, and when the end of the lever 39 is freed by the edge, the spring 49 will cause relative movement of the levers 35 and 39, the lever 39 moving in a generally clockwise direction. Such movement continues until the pin 42 engages the surfaces 42*a*. Moreover, the force exerted by the spring 32 effects clockwise movement of the lever 27, and downward movement of the lever 35. The effect of such movement is that the force exerted by the spring 32 is reduced, and a point is reached at which the effect of the spring 20 is to cause the balls 19 to be urged inwardly. When this occurs and has been explained, the manually operable member 16 moves outwardly, and this is followed by the tongue 22. Such outward movement of the tongue member is eventually transmitted to the lever 27 which is moved in an anti-clockwise direction and causes movement of the lever 35 in an upward direction. The pin 42 engaging with the surfaces 42*a* constitutes a pivot for the lever 39 so that the end thereof, remote from the pin 37 is moved downwardly to a position for engagement with the retaining edge 40. It will be appreciated that the edge 40 may not be in the position in which it is shown in FIG. 1 due to the heating of the temperature sensitive means. The retaining edge 40 will, however, assume this position when the temperature sensitive means has cooled and the circuit breaker is then in a position to be re-operated so as to move the movable contact set 41 into engagement with the fixed contact set.

It is desirable to ensure that the movable contact set 41 is moved quickly into engagement with the fixed contact set so as to minimise sparking, and this is achieved by temporarily retaining the levers 35 and 39 against movement during the initial movement of the tongue member 22 and the operator control member 16. For this purpose the lever 35 is provided with a step 50 which can be engaged by a projection 51 formed at one end of a bell crank lever 52. The bell crank lever is mounted on a pin 53, and is spring loaded so that the projection engages with the side wall of the lever 35. The other end of the bell crank lever is provided with a projection 54 and is engageable by an extended portion of the abutment plate 33 carried by the tongue member 22. The arrangement is such that the projection 51 engages with the step 50, and thereby prevents movement of the levers 35 and 39 until the spring 32 has been compressed a sufficient extent to ensure that the movable contact set 41 will be moved rapidly into engagement with the fixed contact set. The lever 52 is of course moved by the abutment 33.

The temperature sensitive means 48 includes a bimetal element 56 through which electric current flows between one of the terminals 47 and one of the contacts 46 forming the fixed contact set. The bimetallic element is provided with a projection 57 which can engage with one end of a lever 58 which is fitted with an insulating sleeve to electrically isolate the bimetal element 56 from lever 58. The lever 58 is attached substantially half-way along its length to a bracket 63 which is pivotally mounted on pin 28. Movement of the upper end of lever 58 as caused by its engagement with the projection 57 is transmitted to its lower end which is in contact with a latch plate 59. The upper edge of the latch plate 59 is provided with ear portions at its lateral edges which are engaged in recesses 60 in each of the opposite sides of the housing. The recesses are of a triangular shape and permit limited rocking movement of the lower edge of the latch-plate which defines the retaining edge 40. A thin plate member 61 of spring material is secured to the latch plate 59 so as to extend beyond its lower edge 40. The plate 61 serves to accurately define the extent of engagement of the end of lever 39 with the retaining edge 40. Moreover, the thin plate 61 is arranged to extend upwardly of the latch plate 59 to form a leaf spring 62 the upper end of which is biassed so as to contact the upper end of lever 58 and thus to urge the lower end of the latter into contact with the latch plate 59 adjacent edge 40.

In operation, the bimetal 56 will be heated by the passage of current between the terminals 47 and in the event that the flow of current exceeds a predetermined value, the bimetallic member 56 will bow to a sufficient extent to cause the projection 57 to engage the upper end of the lever 58. As a result the lever will be moved and its lower end bearing against the latch plate 59 will cause the retaining edge 40 to move out of engagement with the lever 39. When this occurs the events described take place, and the movable contact set 41 is moved to an inoperative position.

In practice it is found that the bimetal element 56 also bows under the action of normal ambient temperatures which affects to some extent the value of excess current at which the contacts will open. To overcome this lever 58 can be formed of a bimetal material and arranged to compensate for variations of ambient temperature by bowing concordantly with element 56.

It is also required that the contact set 41 should disengage from the fixed contacts 46 in the event of an excessive current flow even if the manually operable member is held forcibly in the normal "contacts-closed" position. It will be seen that the circuit breaker meets this requirement since the lever 39 is free to move under the influence of spring 49 as soon as the retaining edge 40 is moved to the tripped position no matter where the member 16 is situated.

We claim:

1. A thermal circuit breaker of the kind specified comprising a first lever pivotally mounted at one end in the housing, manually operable means for operating said circuit breakers, first resilient means for applying a force to said first lever intermediate the ends thereof, the force exerted on said lever being at least in part dependent upon the position of said manually operable means, second and third levers positioned in the housing, said third lever mounting a movable contact set and having one end shaped to engage and be retained by a retaining edge, the other end of said third lever being pivotally connected to one end of said second lever, the other end of said second lever being operatively connected to the other end of said first lever, second resilient means acting on said third lever, the position of said retaining edge being determined by said temperature sensitive means, the arrangement being such that when the force exerted by said first resilient means is above a predetermined value and the one end of said third lever is retained by said edge, said movable contact set will be in the operative position, and when said edge is moved by the temperature sensitive means the third lever will under the action of said second resilient means, pivot relative to the second lever to move the movable contact set to an inoperative position.

2. A breaker as claimed in claim 1 in which the pivot axis between the second and third levers is movable so that when the third lever is released by said edge, the first and second levers are moved by said first resilient means thereby causing a reduction in the force exerted by said first resilient means.

3. A breaker as claimed in claim 2 in which said pivot axis is constituted by a pin the ends of which are located in slots respectively formed in the side walls of the housing.

4. A breaker as claimed in claim 3 in which said second resilient means acts between said second and third levers.

5. A breaker as claimed in claim 2 in which the reduction in force exerted by said first resilient means is utilized to effect the release of a catch mechanism associated with said manually operable means, said manually operable means returning to an inoperative position, when said catch mechanism is released.

6. A breaker as claimed in claim 5 in which said manually operable means comprises a member forming an abutment for said first resilient means, the member being movable towards said first lever to increase the force exerted by the first resilient means on the first lever, the member having a pin and slot connection with said first lever whereby when the member is moved away from said first lever, a point will be reached at which continued movement of the member in said direction will cause movement of the first lever in a direction to effect movement of said movable contact set to its inoperative position.

7. A breaker as claimed in claim 6 including a manually operable member and a third resilient means which is operable upon release of said catch means, to move said member forming the abutment in said direction.

8. A breaker as claimed in claim 7 in which said member forming the abutment is connected to a tongue member which extends within said manually operable member the latter being slidable within an extension of said housing, said catch means comprising a ball located within an aperture formed in the side wall of said manually operable member, said tongue member having an inclined edge engaging said ball to urge the ball outwardly under the action of said first resilient means, said ball when the manually operable member is in an operative position engaging a step defined in the wall of said extension.

9. A breaker as claimed in claim 8 in which said third resilient means acts on said manually operable member to urge same to an inoperative position, the force exerted by said third resilient means being insufficient in itself to move the manually operable member to the inoperative position unless the force exerted by said first resilient means is reduced.

10. A breaker as claimed in claim 9 in which manual movement of the manually operable member to the inoperative position will effect inward movement of said ball against the action of the third resilient means, the ball during movement of the manually operable member to the inoperative position engaging a further inclined edge on said tongue member to effect movement of the tongue member in said direction.

11. A breaker as claimed in claim 10 in which when said tongue is moved in said direction the resulting movement of said first lever is transmitted through the second lever to the third lever to cause relative movement of the second and third levers, whereby said one end of the third lever is moved to a position to facilitate engagement of said retaining edge without said movable contacts being moved to the operative position.

12. A breaker as claimed in claim 6 including means operable to prevent movement of the second and third levers when it is desired to move the movable contact set to the operative position, until said first resilient means has been stressed a predetermined extent, whereby the movable contact set will move rapidly to the operative position.

13. A breaker as claimed in claim 12 in which said means comprises a bell crank lever defining a projection engageable with a step defined on said second lever and having an arm engageable by said member forming the abutment, said means also including spring means acting to urge said projection into engagement by said step.

14. A breaker as claimed in claim 1 in which said temperature sensitive means comprises a bi-metallic element through which the electric current flowing in the circuit protected by the breaker can flow.

15. A breaker as claimed in claim 14, in which said retaining edge is defined on a latch plate which is pivotally mounted in the respective housing for limited rocking movement, the breaker including a pivoted lever one end of which engages said latch plate and the other end of which is positioned for engagement by said bimetallic element.

16. A breaker as claimed in claim 15 including a plate member secured to said latch plate so as to determine the extent of engagement of the third lever with said edge.

17. A breaker as claimed in claim 16 including a leaf spring secured to said latch plate and acting on said pivoted lever adjacent the other end thereof, said leaf spring acting to urge the lever into engagement with said latch plate.

18. A breaker as claimed in claim 17 in which said leaf spring and said plate member are formed integrally.

19. A breaker as claimed in claim 18 in which said bimetallic element is provided with a projection for engagement with said lever, said lever mounting an insulating sleeve to electrically isolate the lever from the element.

20. A breaker as claimed in claim 17 in which said pivoted lever is formed from a bimetal to provide compensation for variation in the ambient temperature.

* * * * *